United States Patent [19]

Harrington

[11] Patent Number: 4,700,190

[45] Date of Patent: Oct. 13, 1987

[54] MISSILE DECOY RADAR CROSS SECTION ENHANCER

[75] Inventor: John J. Harrington, Tewksbury, Mass.

[73] Assignee: The United States of America as represented by the Secretary of the Air Force, Washington, D.C.

[21] Appl. No.: 84,239

[22] Filed: Oct. 17, 1979

[51] Int. Cl.[4] ..... H01Q 17/00

[52] U.S. Cl. ..... 342/2; 342/5

[58] Field of Search ..... 343/55 A, 18 B, 18 E; 342/2, 5, 9, 15

[56] References Cited

U.S. PATENT DOCUMENTS

| | | | |
|---|---|---|---|
| 3,283,324 | 11/1966 | Norman, Jr. | 343/18 E |
| 3,413,636 | 11/1968 | Migdal | 343/18 B |
| 3,792,477 | 2/1974 | Tomiyasu | 343/18 E |
| 3,866,226 | 2/1975 | Benneche et al. | 343/18 B |
| 4,148,032 | 4/1979 | Kelly et al. | 343/55 A |

*Primary Examiner*—Theodore M. Blum

*Attorney, Agent, or Firm*—Henry S. Miller; Joseph E. Rusz; Donald J. Singer

[57] ABSTRACT

A decoy missile having the shape of a reentry vehicle and containing a pair of conically shaped dipole jacks in tandem, the jacks are shaped and spaced to provide a desired reflective cross section at a specific frequency, the rear cover plate of the decoy is constructed of radar absorbing material to aid in the enhancement process.

1 Claim, 3 Drawing Figures

MISSILE DECOY RADAR CROSS SECTION ENHANCER

STATEMENT OF GOVERNMENT INTEREST

The invention described herein may be manufactured and used by or for the Government of governmental purposes without the payment of any royalty thereon.

BACKGROUND OF THE INVENTION

The present invention relates generally to radar cross section enhancers and more particularly to such an enhancer that would be appropriately utilized in a missle decoy.

There are many reasons to enhance the radar reflectivity of an object. Generally these reasons involve safety and accuracy and are used where space and weight are of concern.

A more subtile reason for radar enhancement is deception. In the game of global conflict, one of the offensive tools that would be used is the intercontinental missile. The fundamental defensive tool is the anti-missile missile, whose task is to destroy the offensive missile. However, because of the time and distances involved defensive action is usually taken to destroy the reentry vehicle after it separates from the offensive missile. Tests have shown that such defense is relatively simple and effective.

In order to thwart this defense, missiles have been developed with multiple reentry vehicles. Due to the limited lifting capability of the missile, most of the reentry vehicles are smaller, lighter decoys with only a limited number of destructive vehicles launched.

Since decoy vehicles are smaller they are readily discriminated out on defensive radar and the destructive vehicles easily identified.

One manner of solving this problem is by including within the decoy an antenna which will reflect a radar cross section that is identical to the destructive vehicle. This however creates an additional problem in that it must be done within the confines of the decoy vehicle.

Many various arrangements have been attempted and some successfully however, each enhancing system is limited to a very small specific frequency range and the degree of enhancement varies substantially with variation in frequency. Therefore as frequencies change so must the decoy enhancement systems.

SUMMARY OF THE INVENTION

The invention relates to an antenna array for selectively controlling the scattering of radar signals. The array is housed in a conical, projectile shaped housing constructed of material that will readily pass radar frequency waves. In the housing the array is supported in place by a low density, low loss foam material.

The antenna array has V-dipole shape with either three or four radiating arrays. The utilization of a pair of V-dipole arrays has been found to provide excellent control over radar back scattering and pattern shape. Individual dipoles may be adjusted in length and angle to provide a desired cross section and the spacing between arrays in adjustable for greater enhancement.

A radar absorbing material covers the interior of the rear cover plate to reduce reflections from the flat surface which interfere destructively with that of the enhancer.

It is therefore an object of the invention to provide a new and improved missile decoy.

It is another object of the invention to provide a new and improved missile decoy with an enhanced radar cross section.

It is a further object of the invention to provide a new and improved missile decoy that is light in weight and inexpensive to manufacture.

It is still another object of the invention to provide a radar scattering antenna array that is capable of being housing in a small space.

It is still a further object of the invention to provide a radar antenna array that utilizes a pair of V-dipole jacks.

It is another object of the invention to provide radar antenna array for enhanced scattering of selected radar frequencies that utilizes three or more swept back dipoles.

These and other advantages, objects and features of the invention will become more apparent after considering the following description taken in connection with the illustrative embodiment in the accompanying drawings.

DESCRIPTION OF THE PREFERRED EMBODIMENT

Figure 1:
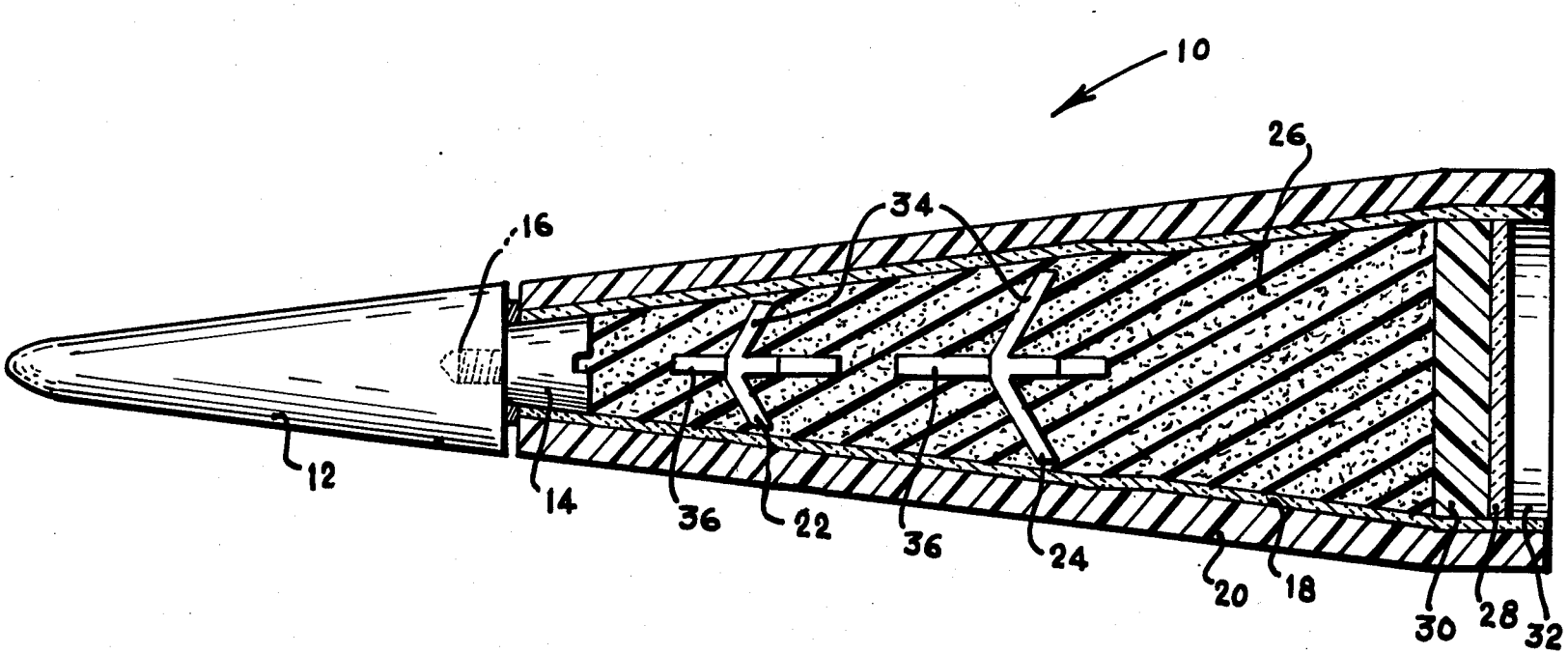
FIG. 1 is a cross section of the invention.

Referring now to FIG. 1, a radar transparent housing is shown generally at 10. At one end of the housing is a conically shaped member 12 for streamlining purposes. Member 12 is made from a conductive material such as carbon or aluminum. A screw plug 14 fits in the housing and has a threaded extension 16 which engages and secures tip 12.

Housing 10 is formed of fiberglass 18 with an outer covering of teflon and is transparent to radar waves. Within the housing are a pair of antenna arrays 22, 24, held in place by a low loss, low density foam 26. End cap 28 seals the array and has a coating of radar wave absorbing material 30 covering the interior surface. A typical material for coating 30 would be Ecc osorb Type ST-T-3, manufactured by Emerson Corning Inc. The housing may be adapted to mate with another device or rocket via the recessed area 32 in housing 10.

Antenna arrays 22 and 24 are similar. A typical array would have three or four dipoles 24 spaced equidistant about a stem 36. The dipole jackarms are typically 1.7 inches in length and swept back by 25°.

The length and sweep of the arms are frequency dependent. Critical is the spacing between arrays 22 and 24.

Figure 2:
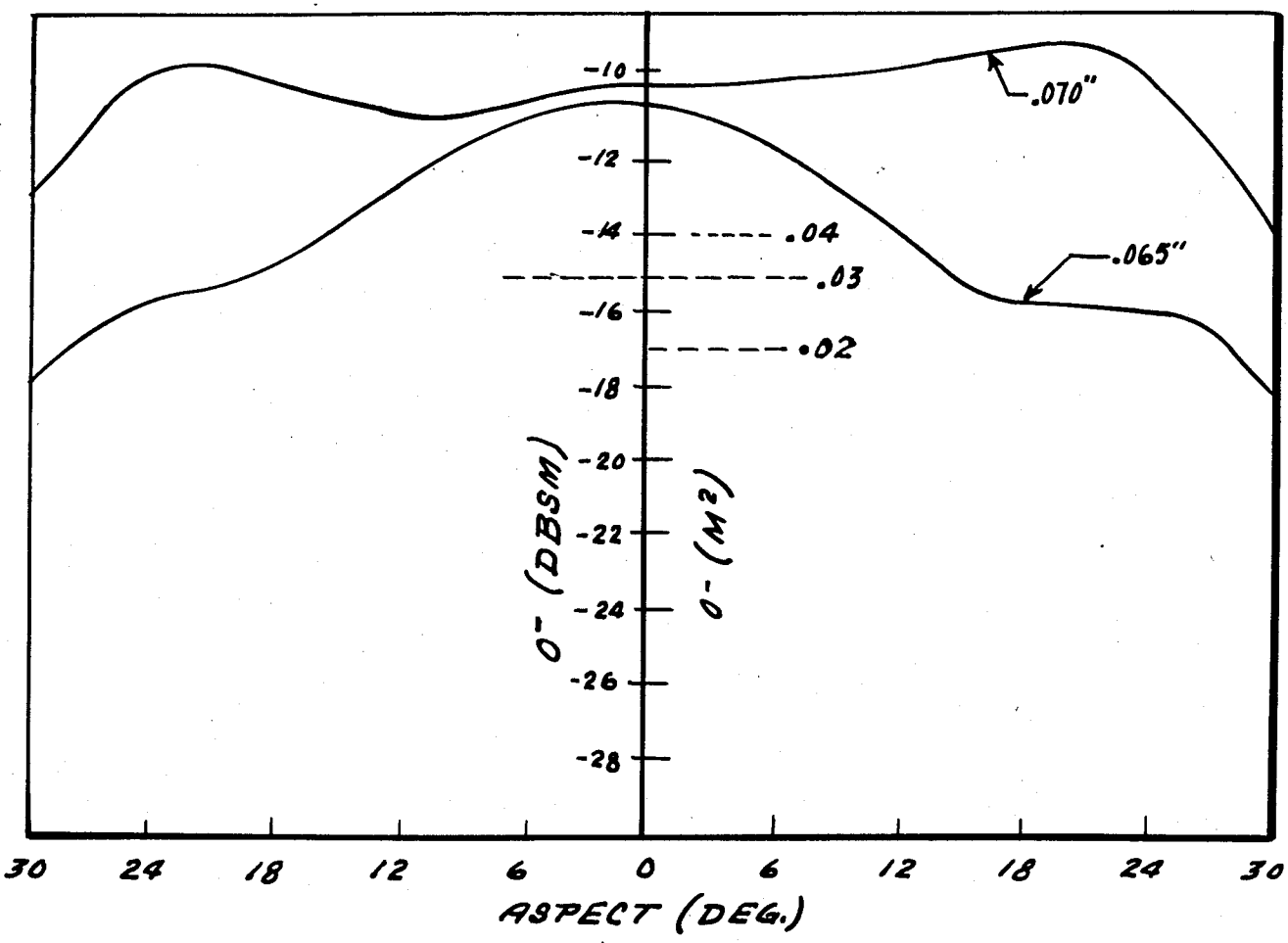
FIG. 2 is a graphic representation of the results of the invention with horizontally polarized radiation.
Figure 3:
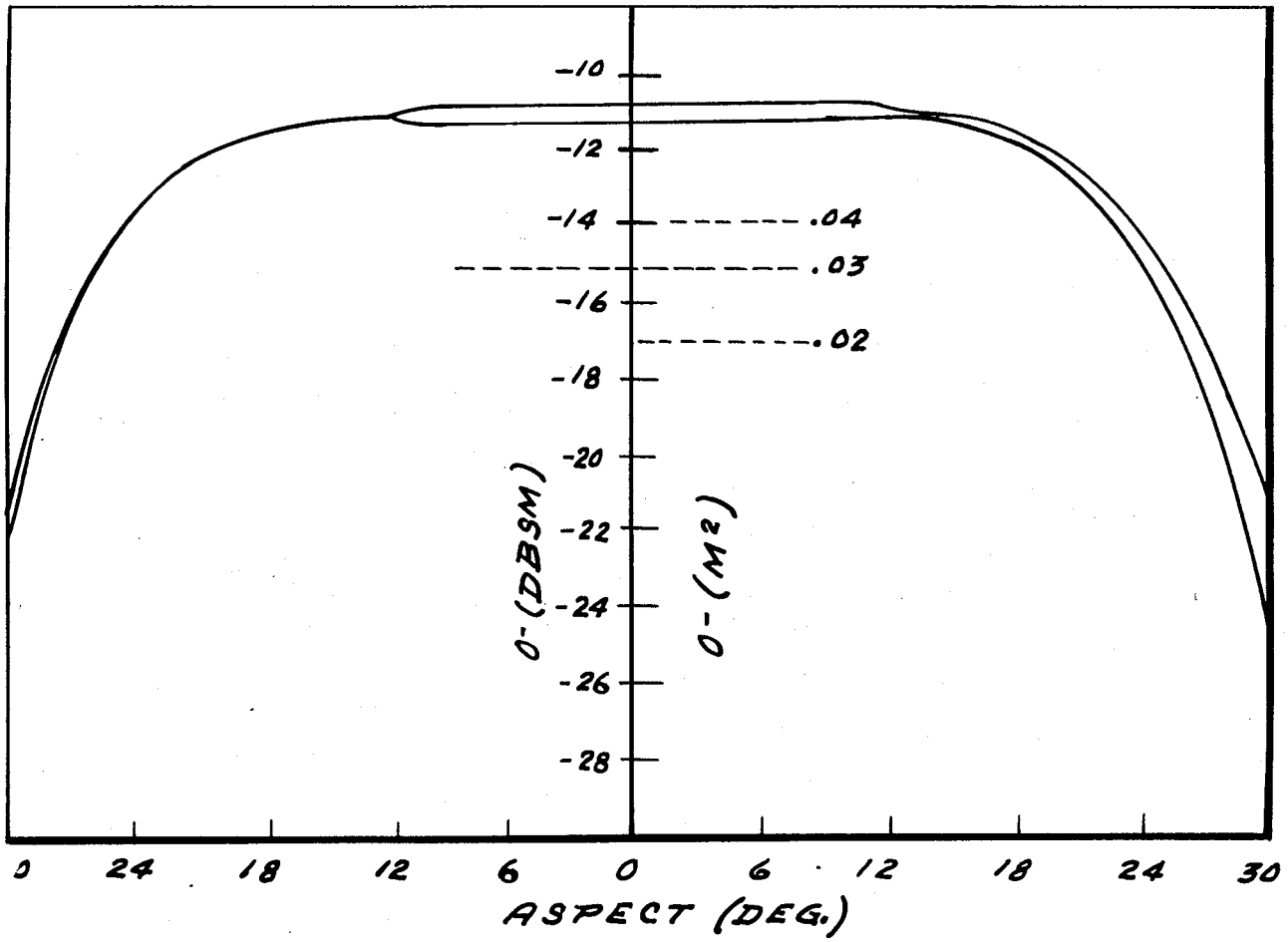
FIG. 3 is a graphic representation of the results of the invention with vertically polarized radiation.

FIGS. 2 and 3 show S-band with horizontal and vertical polarization. Each curve represents the average radar cross section with the forward antenna array (22) in each of two positions. It is significant to note the relatively flat curve over an aspect of ±30°.

Although the invention has been described with reference to a particular embodiment, it will be understood to those skilled in the art that the invention is capable of a variety of alternative embodiments within the spirit and scope of the appended claims.

I claim:

1. A missile decoy with radar cross section enhancing means comprising, a generally conical shaped housing formed of teflon coated fiberglass, the smaller end thereof being closed with a conductive tip and the larger end thereof being closed with an aluminum plate, said aluminum plate being covered internally with radar absorbing material, first and second antennas positioned within the housing in a series relationship, each said antenna being comprised of a stem with two dipole elements affixed thereto at an angle of approximately 25° with the stem's longitudinal axis and orthogonally to each other, the stems of said first and second antennas being aligned with the longitudinal axis of said housing, and low density low loss foam means to support said antennas within said housing means.

* * * * *